US011039702B2

(12) United States Patent
Allen

(10) Patent No.: US 11,039,702 B2
(45) Date of Patent: Jun. 22, 2021

(54) SEPARABLE DRINKING STRAW TO FACILITATE CLEANING OF INTERNAL WALLS

(71) Applicant: April Allen, Riverside, CA (US)

(72) Inventor: April Allen, Riverside, CA (US)

( * ) Notice: Subject to any disclaimer, the term of this patent is extended or adjusted under 35 U.S.C. 154(b) by 0 days.

(21) Appl. No.: 16/004,260

(22) Filed: Jun. 8, 2018

(65) Prior Publication Data

US 2018/0352983 A1 Dec. 13, 2018

Related U.S. Application Data

(60) Provisional application No. 62/518,528, filed on Jun. 12, 2017.

(51) Int. Cl.
*A47G 21/18* (2006.01)

(52) U.S. Cl.
CPC ..... *A47G 21/18* (2013.01); *A47G 21/183* (2013.01)

(58) Field of Classification Search
CPC ..... A47G 21/18; A47G 21/183
USPC ..... 239/33, 1, 12, 24; 138/109
See application file for complete search history.

(56) References Cited

U.S. PATENT DOCUMENTS

| | | | | |
|---|---|---|---|---|
| 6,247,500 | B1 * | 6/2001 | McMahon | F16L 9/22 138/157 |
| 6,431,216 | B1 * | 8/2002 | Briscoe | F16L 55/17 138/110 |
| 6,702,193 | B1 | 3/2004 | Gates | |
| 2005/0218242 | A1 | 10/2005 | Renz et al. | |
| 2008/0023567 | A1 | 1/2008 | Byerly | |
| 2012/0055942 | A1 | 3/2012 | Claessens | |
| 2013/0020402 | A1 | 1/2013 | Wallace | |
| 2013/0126527 | A1 | 5/2013 | Chiu et al. | |
| 2015/0034544 | A1 | 2/2015 | Aftoora | |
| 2017/0251850 | A1 | 9/2017 | Coon et al. | |

FOREIGN PATENT DOCUMENTS

| | | | | |
|---|---|---|---|---|
| KR | 2018001331 | * | 6/2016 | A47G 21/18 |
| KR | 20160146533 | A | 12/2016 | |
| KR | 101763182 | B1 | 7/2017 | |
| KR | 20170086767 | A | 7/2017 | |
| KR | 101861432 | B1 | 5/2018 | |

* cited by examiner

*Primary Examiner* — Qingzhang Zhou
(74) *Attorney, Agent, or Firm* — Kenneth Avila

(57) ABSTRACT

Disclosed is a drinking straw that may be separated along its longitudinal axis into two halves so that the internal walls of the straw may be easily cleaned. The halves may then be rejoined together to again form a straw so that the straw may be easily reused.

3 Claims, 3 Drawing Sheets

SEPARABLE DRINKING STRAW TO FACILITATE CLEANING OF INTERNAL WALLS

CROSS-REFERENCE TO RELATED APPLICATIONS

This application claims priority from U.S. Provisional Patent Application No. 62/518,528 filed on Jun. 12, 2017. The entire disclosure of the prior application is considered to be part of the disclosure of the accompanying application and is hereby incorporated by reference.

BACKGROUND OF THE INVENTION

1. Field of the Invention

The present invention, in general relates to drinking straws and, more particularly, to a drinking straw that may be easily separated along its longitudinal axis so that its internal walls may be cleaned and then reassembled for subsequent uses.

2. Description of the Related Art

According to an article published by CNN on Jan. 14, 2018, titled "The last straw: Is time up for this plastic relic?" it is stated that every day, Americans throw away 500 million plastic drinking straws ("straws"), enough to circle the Earth twice, or fill 125 school buses. This number, 500 million straws, is confirmed by other news publications and websites that promote environmental awareness. Although straws are only part of the growing problem presented by plastic waste, they are particularly damaging in that their ridged construction makes it difficult for animals, principally marine animals, to expel straws that have been consumed from their digestive system.

The primary reason why straws are disposed of is that it is difficult to clean their internal walls of any residue that remains after using the straw. It is far easier to simply discard the straw rather than to clean and reuse it. Therefore, in spite of their environmental problems, straws remain popular for many reasons. For some elderly individuals, or those with particular disabilities, it may be difficult or impossible to consume liquids without a straw. Another class of candidates for using straws are smaller children who have not mastered the art of drinking from a cup. Another example includes individuals that prefer using a straw at a restaurant establishment as they are more comfortable with drinking from a straw than from the cup or that they believe using a straw to be more sanitary than the edges of the cup. Thus, there exists a need for a straw that may be easily separated along its longitudinal axis to allow its internal walls to be readily cleaned and then reassembled and reused by a variety of individuals of all ages.

Korean patent 101763182 discloses multiple embodiments of straws that are formed from a single piece of plastic that may be folded and joined at a point on its outer surface along its longitudinal axis to form a straw and subsequently to unjoin and unfold the straw so that its internal walls may be cleaned. The process is then repeated to reassemble and reuse the straw. Some of the embodiments are directed to straws that have a rectangular cross section when assembled. These embodiments are constructed from a single piece of plastic with at least four panels and typically five panels. The thickness of the plastic adjoining each panel is thinner to facilitate the folding process between the panels. Embodiments with four panels have mechanisms to join the exposed edge of the first panel with the exposed edge of the fourth panel when forming the straw. Embodiments with five panels have mechanisms to join the first panel with the fifth panel when these two panels overlap each other when forming the straw. A straw is formed by folding the plastic so that each panel has a perpendicular relationship to its adjacent panel or panels. Once the panels have been folded, mechanisms to join the first panel with the final panel are used to prevent the straw from unfolding. Straws with rectangular cross sections may be difficult to use by individuals who are not able to close their lips about the straw to seal outside air from entering the mouth when the user inhales to draw the liquid being consumed through the straw. If the liquid to be consumed is particularly viscous it may not be possible to consume the liquid through the straw unless the seal of the lips about the straw is complete. Other embodiments are directed to straws with a circular cross section that may be releasably joined together along its longitudinal axis at a joining point on its circumference. Mechanisms at the joining point allow the edges to be releasably joined together. By pulling the edges apart at the joining point the internal walls are exposed so that they may be cleaned. Once cleaned the edges may be rejoined to once again form the straw. Although these embodiments have a circular cross section and are easier to use than the embodiments with rectangular cross sections, the internal walls of these embodiments are difficult to clean. These straws, having a cylindrical form, do not by themselves "open" when pulled apart at its joining point. Additional force must be continually applied to the edges in order to expose the internal wall of the straw for cleaning. Some of these embodiments disclose a weakened section of the wall opposite the joining point to reduce the amount of additional force that must be applied to the edges of the joining point to open the straw for cleaning. The presence of weakened wall sections in both the rectangular and circular embodiments increase the likelihood of breakage or cracking along those sections. The various straw embodiments disclosed by the 101763182 patent may be difficult to use because of their rectangular cross section, may be difficult to clean because of their cylindrical form, and have weakened wall sections that increase the likelihood of a failure along those weakened wall sections.

Korean patent 101861432 discloses multiple embodiments of straws that are comprised of two halves along its longitudinal axis that may be separated by either pulling or sliding the halves apart. Once the two halves have been separated the internal walls may be easily cleaned and the reverse action may be taken to rejoin the halves together. The embodiments all disclose the use of dovetail joints to join the two halves together. Some embodiments do not have a circular cross section and thus suffer the same disadvantage present in the rectangular cross section embodiments of the 101763182 patent previously discussed when using lips to create a seal about the circumference of the straw. The 101861432 patent discloses that the halves may be separated and rejoined by pulling or pressing the halves together. It is not understood how the halves may be pulled apart as claimed because dovetail joints exhibit great tensile strength. Likewise, it is not understood how the halves may be pressed together as claimed because dovetail joints cannot be joined as shown in the disclosures because their trapezoidal shape are inverse with each other. It is understood that the halves may be separated or joined by a sliding action that then forms the dovetail joints. However, the trapezoidal features that form the dovetail joints are difficult to fabricate because (i) of their small size being on the longitudinal edge of the half and (ii) and that the trapezoidal feature runs along the entire edges of the halves. The small size requires precision molding and the length of the trapezoidal feature increases the likelihood that a defect will exist thus preventing the halves from being joined together. While the various straw embodiments disclosed by the 101861432 patent fully expose the internal walls for cleaning they may be difficult to use because of their non-circular cross section and difficult to fabricate because of the existence of precision trapezoidal features on its edges.

Known straws that allows their internal walls to be exposed for cleaning in order to be reused have difficult to use non-circular cross sections, prone to failure because of weakened wall sections, difficult to fabricate as they contain trapezoidal features that run the length of the straw to join the halves of the straw, or they are formed as a cylinder requiring greater effort to open the straw for cleaning its internal walls. There exists a need for a straw that is easier to use with a circular cross section, simpler to fabricate, and to assemble and reassemble so that the internal walls may be cleaned.

BRIEF SUMMARY OF THE INVENTION

The present invention to be disclosed herein is for a straw that has a circular cross section that comprises two halves that is separable along its longitudinal axis.

It is an objective of the present invention for the halves to be easily manufactured.

It is an objective of the present invention for the halves to separate and be reunited effortlessly.

It is an object of the present invention for the internal walls of each half to be fully exposed when separated to facilitate cleaning of the internal walls.

It is an object of the present invention for the structure of the straw to be durable to withstand misuse and to be reused repeatably.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

Neither this summary nor the following detailed description defines or limits the invention. The invention is defined by the claims.

BRIEF DESCRIPTION OF DRAWINGS

The present invention will become more fully understood from the detailed description and accompanying drawings, wherein.

DETAILED DESCRIPTION OF THE INVENTION

The following description of the preferred embodiment(s) is merely exemplary in nature and is in no way intended to limit the invention, its application, or uses.

Figure 1:
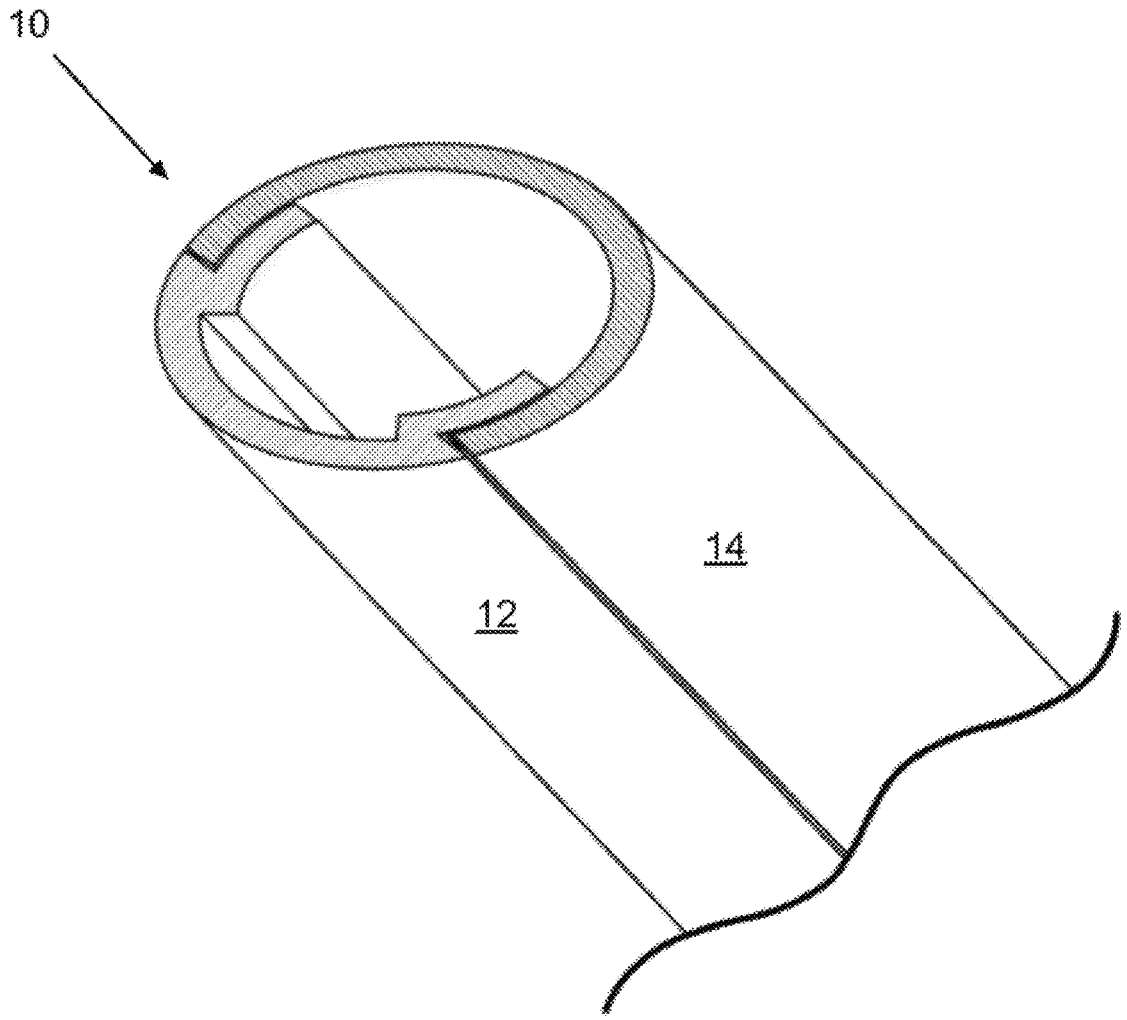
FIG. 1 shows an isometric view of the preferred embodiment of the present invention showing in separate hatchings the two halves of the straw.

FIG. 1 shows an isometric view of the straw the preferred embodiment of the present invention. The straw is comprised of two halves: 12 and 14. For naming conventions half 12 will be referred to as "left half" and half 14 will be referred to as "right half". The outermost circumference of left half 12 and right half 14 is in the shape of an arc with the radius of the arc being the same between the two halves and when the halves are combined a complete circle is formed. The length of left half 12 and right half 14 are identical and when joined together form a cylindrical object of a constant diameter with a proximal and distal end cut perpendicular to the longitudinal axis of the cylinder and the interior being void, in short a straw. Right half 14 is a simply an arc of a certain thickness, with an outer and inner surface, arc length, and longitudinal length. The arc length of right half 14 is generally shown in the figures as occupying more than 180° but it may vary and occupy less than 180° as long as when combined with left half 12 a complete circle is formed. Left half 12 is a more complex geometric structure than right half 14 but likewise comprises an arc with a certain thickness, with an outer and inner surface, arc length, and longitudinal length. The arc length of left half 12 is generally shown in the figures as occupying less than 180° but it may vary and occupy more than 180° as long as when combined with right half 14 a complete circle is formed. In addition to the arc, left half 12 contains two flanges that mate with the inner surface of right half 14. The flanges will be discussed in detail when discussing FIG. 2.

Figure 2:
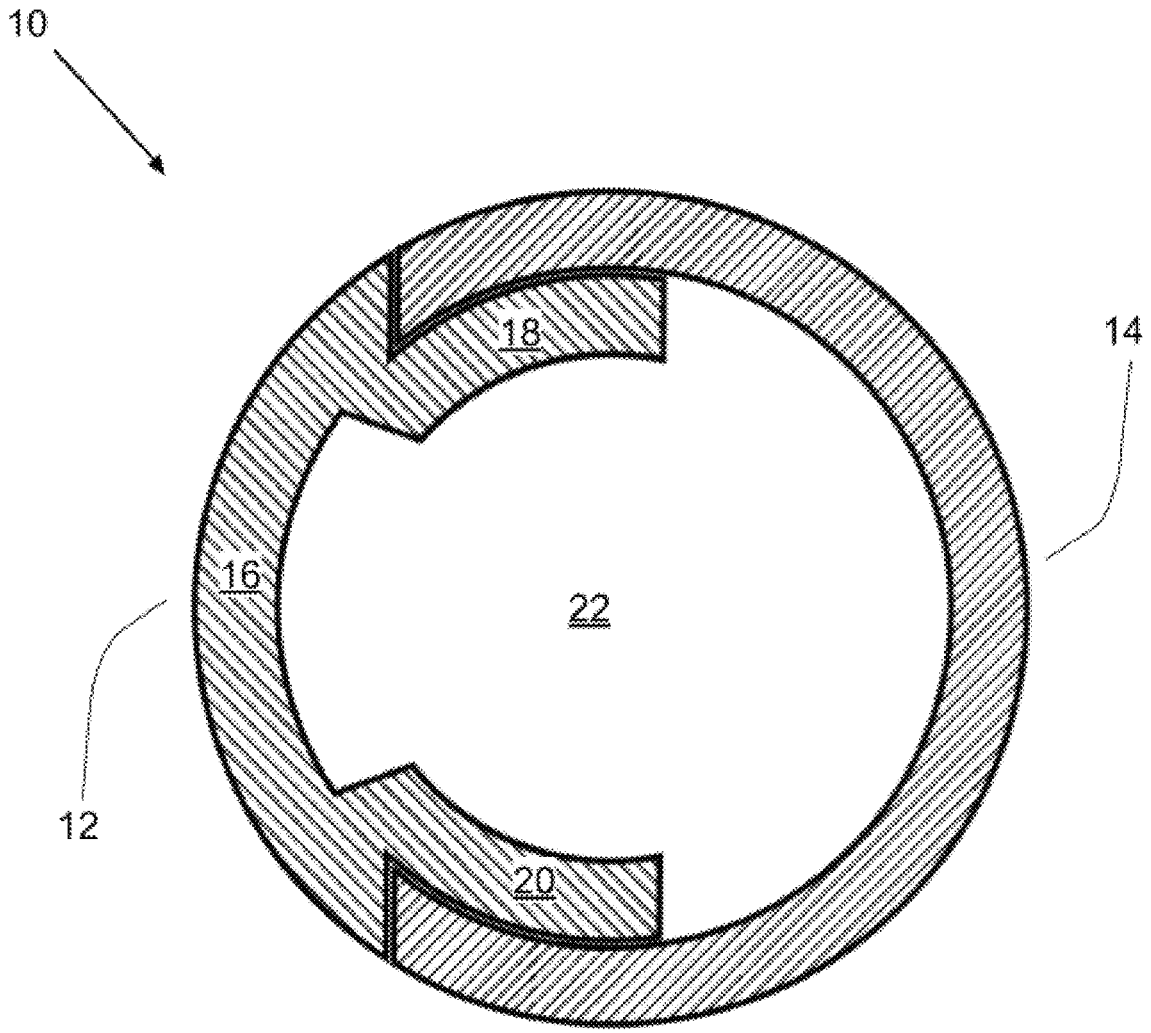
FIG. 2 shows a cross section view of the preferred embodiment of the present invention with the two halves indicated by separate hatchings.

FIG. 2 shows a cross section view of straw 10 with left half 12 and right half 14 indicated by separate hatchings. As disclosed earlier right half 14 is a simply an arc of a certain thickness, with an outer and inner surface, arc length, and longitudinal length. The arc length of right half 14 is generally shown in the figures as occupying more than 180° but it may vary and occupy less than 180° as long as when combined with left half 12 complete circle is formed. Left half 12 is a more complex geometric structure than right half 14 but likewise comprises arc 16 with a certain thickness, with an outer and inner surface, arc length, and longitudinal length. The arc length of arc 16 is generally shown in the figures as occupying less than 180° but it may vary and occupy more than 180° as long as when combined with right half 14 a complete circle is formed. In addition to arc 16, left half 12 contains two flanges indicated as upper flange 18 and lower flange 20. The outer surface of the flanges mate with the inner surface of right half 14 so as to secure right half 14 to left half 12 by friction. The length of the flanges may be increased or decreased to change the amount of friction holding the halves together with longer flanges increasing the amount of friction while shorter flanges decreasing the amount of friction holding the halves together. The length of the flanges also contribute to how well outside air is sealed from void 22 formed when the two halves are joined together with longer flanges increasing the seal and shorter flanges decreasing the seal. When fabricating straw 10 with tight manufacturing tolerances the flanges may be shortened and still provide sufficient friction to hold the halves together and seal outside air from void 22. When fabricating straw 10 with loose manufacturing tolerances the flanges will need to be lengthened to provide sufficient friction to hold the halves together and seal outside air from void 22. The flanges overlap and are attached to the inner surface of arc 16.

Figure 3:
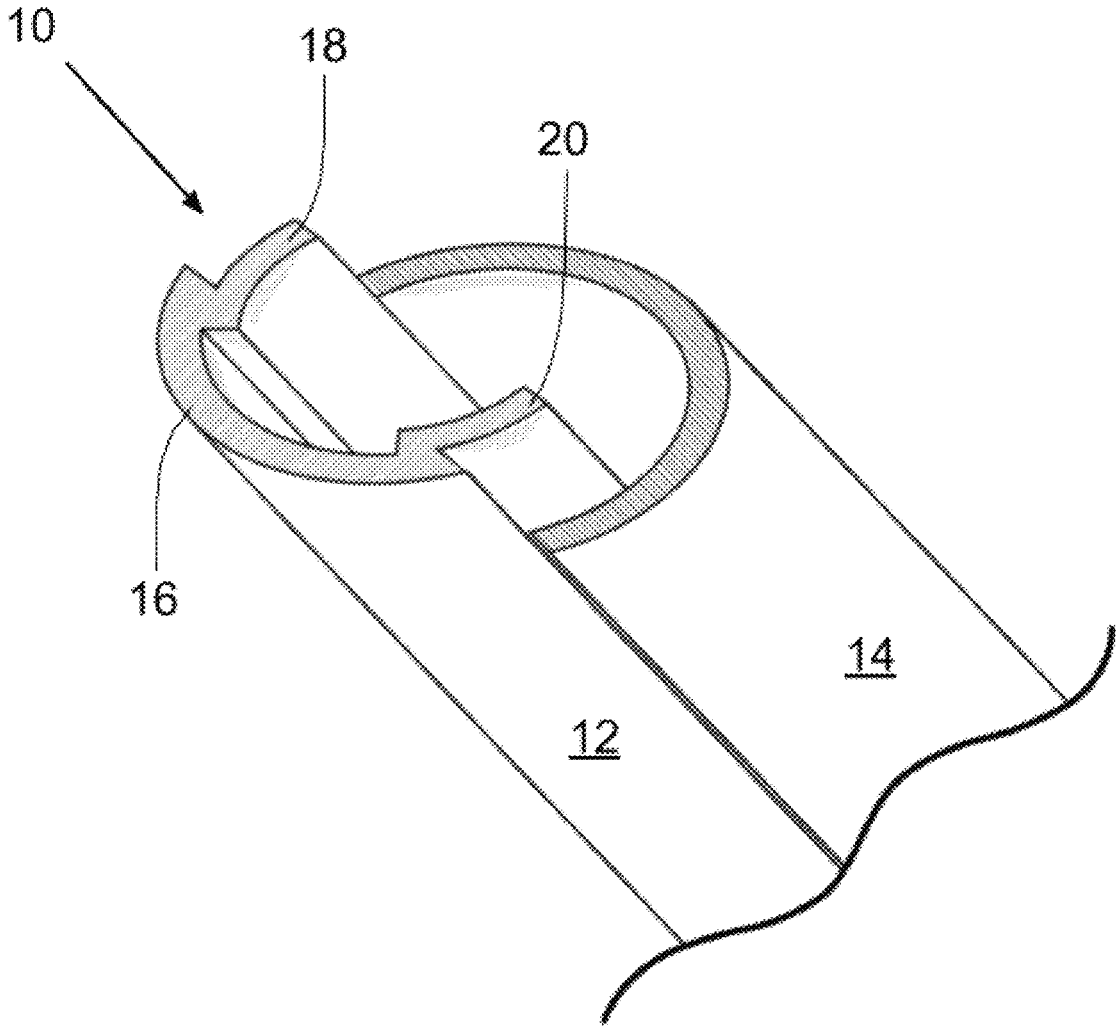
FIG. 3 shows an isometric view of the preferred embodiment of the present invention showing in separate hatchings the two halves of the straw with one of the halves being slightly apart from the other.

FIG. 3 is similar to FIG. 1 in that it shows an isometric view of straw 10 but with the two halves being slightly offset from each other to better show how left half 12 engages with right half 14 by using upper flange 18 and lower flange 20.

Although the present invention and its advantages have been described in detail, it should be understood that various changes, substitutions and alterations can be made herein without departing from the spirit and scope of the invention as defined by the appended claims. For example, upper flange 18 and lower flange 20 may meet to totally fill in the space adjoining arc 16. Moreover, the scope of the present application is not intended to be limited to a particular composition of matter. Accordingly, the claims are intended to include within their scope such variations and compositions of matter.

What is claimed is:

1. A drinking straw comprising two halves along a longitudinal axis of the drinking straw the first half being an arch along the longitudinal length of said drinking straw having a first end and a second end along its longitudinal axis, a proximal edge at one end of the arc of the arch and a distal edge at the opposing end of the arc of the arch, an outer surface, an inner surface, and a constant radius with the proximal edge and the distal edge of the arch forming a flat planar surface bounded by the first end, second end, outer surface, and inner surface of the arch;

the second half being an arch along the longitudinal length of said drinking straw having a first end and a second end along its longitudinal axis, a proximal edge at one end of the arc of the arch and a distal edge at the opposing end of the arc of the arch, an outer surface, an inner surface, a constant radius a first flange affixed to the arch's inner surface extending along the arch's proximal edge to engage said first half's inner surface and a second flange affixed to the arch's inner surface extending along the arch's distal edge to engage said first half's inner surface with the proximal edge and the distal edge of the arch forming a flat planar surface bounded by the first end, second end, outer surface, and inner surface of the arch; and the arch of said first half and the arch of said second half forming a right circular hollow cylinder when said first half is joined with said second half.

2. The drinking straw of claim 1 wherein the radius of said outer surface of said first half and the radius of said outer surface of said second half are equal.

3. The drinking straw of claim 1 wherein the longitudinal length of said first half and the longitudinal length of said second half are equal.

* * * * *